US007022449B2

(12) United States Patent
Sugahara et al.

(10) Patent No.: US 7,022,449 B2
(45) Date of Patent: Apr. 4, 2006

(54) BLACK TONER WITH DEFINED LOSS TANGENT

(75) Inventors: Nobuyoshi Sugahara, Shizuoka (JP); Takaaki Kohtaki, Shizuoka (JP); Yasuhiro Ichikawa, Shizuoka (JP); Tetsuya Ida, Shizuoka (JP); Kazuhiko Hayami, Shizuoka (JP); Nozomu Komatsu, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/629,751

(22) Filed: Jul. 30, 2003

(65) Prior Publication Data

US 2004/0058264 A1 Mar. 25, 2004

(30) Foreign Application Priority Data

Jul. 30, 2002 (JP) ..... 2002-220975

(51) Int. Cl.
*G03G 9/08* (2006.01)
*G03G 9/087* (2006.01)

(52) U.S. Cl. ..... 430/111.4; 430/108.9; 430/109.3; 430/109.4

(58) Field of Classification Search ..... 430/111.4, 430/109.3, 109.4, 108.9
See application file for complete search history.

(56) References Cited

U.S. PATENT DOCUMENTS

| | | | | |
|---|---|---|---|---|
| 4,904,560 | A | 2/1990 | Yamashiro et al. | 430/137 |
| 6,030,737 | A | 2/2000 | Ugai et al. | 430/106 |
| 6,586,147 | B1 | 7/2003 | Iida et al. | 430/45 |
| 6,656,654 | B1 * | 12/2003 | Higuchi et al. | 430/110.3 |
| 2002/0081513 | A1 * | 6/2002 | Higuchi et al. | 430/109.4 |
| 2003/0165760 | A1 * | 9/2003 | Higuchi et al. | 430/110.3 |

FOREIGN PATENT DOCUMENTS

| | | |
|---|---|---|
| EP | 1 069 479 A1 | 1/2001 |
| EP | 1 205 810 A2 | 5/2002 |
| JP | 49-42354 | 4/1974 |
| JP | 55-26518 | 2/1980 |
| JP | 58-60754 | 4/1983 |
| JP | 61-277964 | 12/1986 |
| JP | 64-35457 | 2/1989 |
| JP | 1-145664 | 6/1989 |
| JP | 7-64337 | 3/1995 |
| JP | 10-186713 | 7/1998 |

* cited by examiner

*Primary Examiner*—Christopher Rodee
(74) *Attorney, Agent, or Firm*—Fitzpatrick, Cella, Harper & Scinto

(57) ABSTRACT

To provide a black toner having excellent charging property and transferring property against a severe environmental change. The black toner includes toner particle containing at least a binder resin, carbon black and a releasing agent, wherein: the toner particles have a weight-average particle diameter of 3.5 to 8.0 μm; total amount of acid value and hydroxyl value of the toner is 30 to 75 mgKOH/g; average circularity of particles contained in the toner having circle-equivalent diameter of 2 μm or more is 0.915 to 0.960; loss tangent tan δ ($10^3$ to $10^4$ Hz) of the toner is represented by the following expression:

$$\tan\delta(10^3 \text{ to } 10^4 \text{ Hz}) \leqq 0.0060$$

where the loss tangent tan δ is represented by ∈"/∈' where ∈" denotes dielectric loss factor and ∈' denotes dielectric constant, and tan δ ($10^3$ to $10^4$ Hz) denotes the loss tangent in a frequency range of $10^3$ to $10^4$ Hz; and a ratio of tan δ ($10^5$ Hz) to tan δ ($5\times10^4$ Hz) is represented by the following expression:

$$1.05 \leqq \tan\delta(10^5 \text{ Hz})/\tan\delta(5\times10^4 \text{ Hz}) \leqq 1.40$$

where tan δ ($10^5$ Hz) denotes loss tangent at the frequency of $10^5$ Hz and tan δ ($5\times10^4$ Hz) denotes loss tangent at the frequency of $5\times10^4$ Hz.

2 Claims, 2 Drawing Sheets

BLACK TONER WITH DEFINED LOSS TANGENT

BACKGROUND OF THE INVENTION

1. Field of the Invention

The present invention relates to a black toner used for an electrophotography method, an electrostatic printing method, a toner jet method, or the like.

2. Description of the Related Art

Up to now, many problems occur when using carbon black as a coloring agent for the production of toner.

First, carbon black has a small primary particle diameter and a large specific surface area as compared with other pigments. Therefore, carbon black is hardly dispersed or is unevenly distributed on the surface of a toner particle. Further, free carbon black is easily produced. Because carbon black is fine particle having a high adhesiveness, presence of free carbon black causes deterioration of flowability of toner and prevents satisfactory triboelectric charging, and particularly tends to deteriorate reproducibility of a half-tone image. Moreover, in the case where carbon black is not sufficiently dispersed, a problem also arises in that a sufficient image density is not obtained.

Secondly, charges of toner easily leak when the carbon black is present on the surface of toner because the carbon black has conductivity. Therefore, when forming image by using such toner, fogging, toner scattering, or transfer skip occurs.

JP 64-35457 A and JP 01-145664 A are applications relating to improvement of dispersibility of carbon black. However, it cannot be said yet that the problems concerning dispersibility are completely solved.

Moreover, JP 07-64337 A and JP 10-186713 A disclose the improvement of dispersibility of carbon black and charging property of toner by combining carbon black having specific physical property and an azo-based iron compound having a specific structure. For example, the method disclosed in JP 10-186713 A is a superior method of obtaining toner having high coloring property and stable charging property but it has a few problems on solid image uniformity and durability under a high-humidity environment.

Furthermore, since an awareness regarding a global environmental issue is growing up, there arises a tendency of using all resources effectively. As for the toner, several attempts have been made. One of such attempts is "a reduction of waste toner". The waste toner is one which is not successfully transferred to a transfer material such as paper after developed on a photosensitive drum, and it should be reduced in every way in view of effective use of resources. Methods of improving transferring property by using external additives so as to reduce the waste toner are described in, for example, JP 49-042354 A, JP 55-026518 A, JP 58-060754 A and JP 61-277964 A. However, in order to further reduce the waste toner, it has been eagerly demanded to more finely disperse carbon black in a toner particle so as to improve the transferring property.

SUMMARY OF THE INVENTION

It is an object of the present invention to provide a black toner for being used in oil-less fixing, which solves the above-mentioned problems and has excellent charging property and transferring property against a severe environmental change.

The object of the present invention is attained by the following arrangement.

That is, according to the present invention, there is provided a black toner including toner particle containing at least a binder resin, carbon black and a releasing agent, in which:

the toner particles have weight-average particle diameter of 3.5 to 8.0 μm;

total value of acid value and hydroxyl value of the toner is 30 to 75 mgKOH/g;

average circularity of particles contained in the toner having circle-equivalent diameter of 2 μm or more is 0.915 to 0.960;

loss tangent tan δ ($10^3$ to $10^4$ Hz) of the toner is represented by the following expression:

$$\tan\delta(10^3 \text{ to } 10^4 \text{ Hz}) \leqq 0.0060$$

where the loss tangent tan δ is represented by ∈"/∈' where ∈" denotes dielectric loss factor and ∈' denotes dielectric constant, and tan δ ($10^3$ to $10^4$ Hz) denotes the loss tangent in a frequency range of $10^3$ to $10^4$ Hz; and a ratio of tan δ ($10^5$ Hz) to tan δ ($5\times10^4$ Hz) is represented by the following expression:

$$1.05 \leqq \tan\delta(10^5 \text{ Hz})/\tan\delta(5\times10^4 \text{ Hz}) \leqq 1.40$$

where tan δ ($10^5$ Hz) denotes loss tangent at the frequency of $10^5$ Hz and tan δ ($5\times10^4$ Hz) denotes loss tangent at the frequency of $5\times10^4$ Hz.

BRIEF DESCRIPTION OF THE DRAWINGS

Other objects and advantages of the present invention will become apparent during the following discussion, in conjunction with the accompanying drawings, in which.

DETAILED DESCRIPTION OF THE PREFERRED EMBODIMENTS

Figure 1:
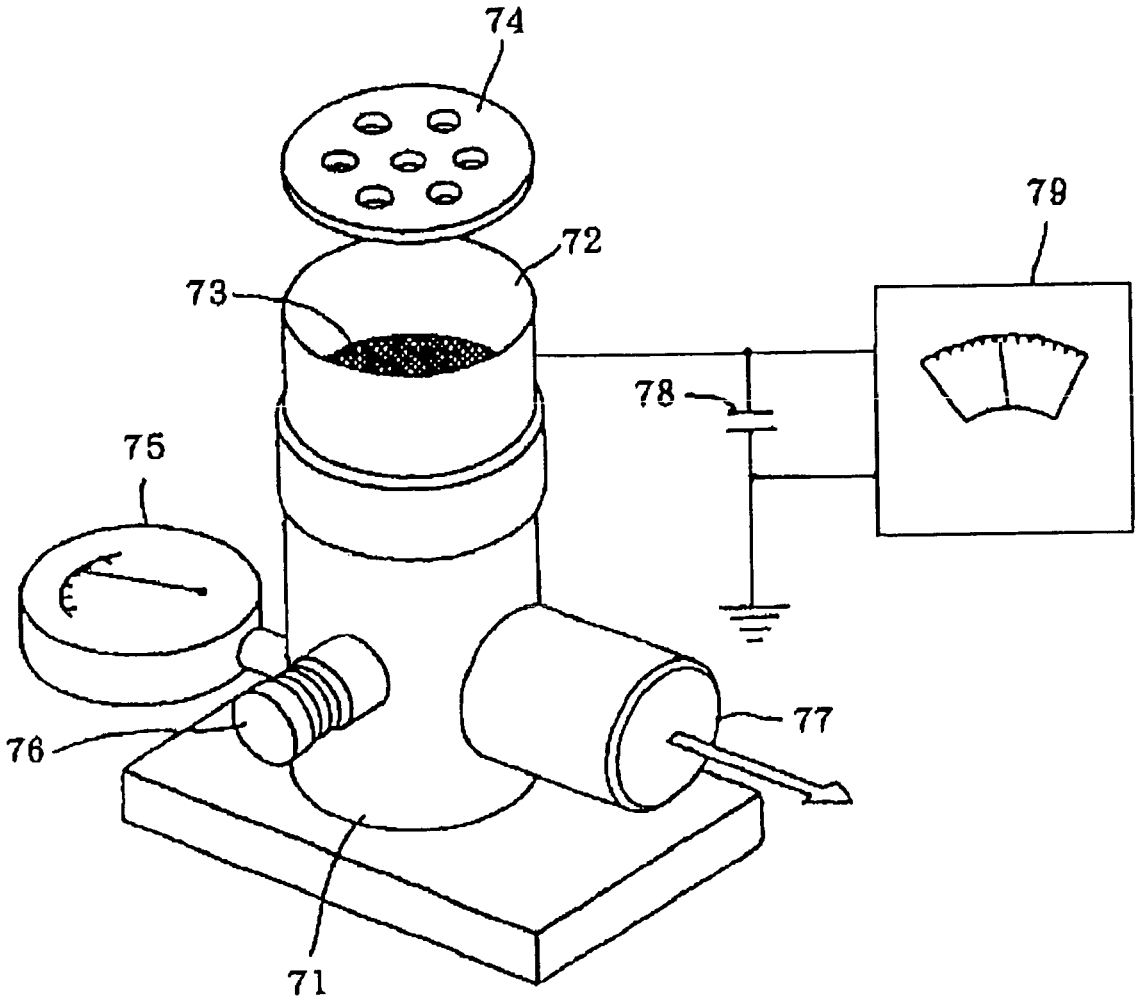
FIG. 1 is a schematic view illustrating a preferred form of apparatus used for measuring a triboelectric charging amount in the present invention.

Hereinafter, preferred embodiments according to the present invention will be described in detail.

The present inventors have found with regard to a black toner containing carbon black that: a black toner having excellent charging property and transferring property against a severe environmental change and therefore always forming a stable image is provided by improving dispersibility of carbon black with removing carbon black which exists on the surface of toner particles and a free carbon black separated therefrom.

According to the present inventors' study, it is important to select a binder resin having relatively large value of the total of acid value and hydroxyl value for improving dispersibility of the carbon black. Although the definitive reason therefor is not clear, it is conceivable that: since there exist polar groups such as hydroxyl group or carboxyl group on carbon black surface, the carbon black is easily dispersed into the binder resin having relatively large number of polar groups. The toner containing a resin component having the total of the acid value and the hydroxyl value of 30 to 75 mgKOH/g, more preferably 40 to 70 mgKOH/g shows excellent dispersibility of the carbon black.

If the total of the acid value and the hydroxyl value is less than 30 mgKOH/g, the toner tends to cause defective charging of the resultant toner, formation of uneven image, fogging or the like, probably because the carbon black is hardly dispersed in the toner particles. If the total of the acid value and the hydroxyl value exceeds 75 mgKOH/g, the toner tends to cause scattering of the toner or deterioration of transferring property because the charge of the toner easily leaks due to an increase of hygroscopicity of the binder resin.

Furthermore, the present inventors have found that dispersibility of the carbon black is improved by containing an organometallic compound in the toner. The definitive reason is not clear, either. However, it is conceivable that: since respective polar groups in the organometallic compound and the carbon black attract each other, respective dispersibilities of the organometallic compound and the carbon black in the binder resin are increased.

Furthermore, dispersibility of the carbon black is improved by containing a releasing agent in the toner particles. In particular, it has been found that the releasing agent having low melting point is especially effective. It is conceivable that the releasing agent having low melting point enters pores of the carbon black particles and therefore wettability with the binder resin is increased so as to improve dispersibility of the carbon black. Furthermore, it has been found that deposition of the releasing agent on the toner particle surface is effectively reduced by improving dispersibility of both the releasing agent and the carbon black.

As an index for a degree of dispersibility of the carbon black, loss tangent tan δ, which is represented by the ratio of dielectric loss factor ∈" to dielectric constant ∈', is known as described in page 241 of "Characteristic and most suitable combination of the carbon black and technique using the same" published by Gijutsu Joho Kyokai. The smaller the value of tan δ is, the better dispersibility of the carbon black is. The present inventors have found that especially the tan δ value at the specific frequency of $10^3$ to $10^4$ Hz is closely related to charge stability, and as a result of the further study, the present inventors have defined the following. The black toner of the present invention has "tan δ ($10^3$ to $10^4$ Hz)" of 0.0060 or less, preferably 0.0055 or less. Here, "tan δ ($10^3$ to $10^4$ Hz)" denotes tan δ in a frequency range of $10^3$ to $10^4$ Hz. If the tan δ ($10^3$ to $10^4$ Hz) exceeds 0.0060, charge amount distribution of the toner tends to be broad. As a result, under a low humidity condition, insufficient image density or fogging due to excessive charging-up of the toner would be caused. In contrast, under a high humidity condition, fogging, toner scattering or deteriorated transferring property due to insufficient charge amount of the toner would be caused.

Furthermore, the present inventors have found that a toner having the relationship represented by the below-indicated equation is capable of forming stable image against a severe environmental change:

$$1.05 \leqq \tan\delta(10^5\ \text{Hz})/\tan\delta(5\times10^4\ \text{Hz}) \leqq 1.40.$$

In the above equation, "tan δ ($10^5$ Hz)" denotes loss tangent tan δ at the frequency of $10^5$ Hz and "tan δ ($5\times10^4$ Hz)" denotes loss tangent tan δ at the frequency of $5\times10^4$ Hz. Although the definitive reason is not clear, the present inventors can assume that: the frequency difference in the loss tangent measurement corresponds to an environmental difference, for example, difference between low temperature and low humidity environment, and high temperature and high humidity environment. Therefore, it is assumed that the loss tangents at different frequencies are represented as an index of the balance of charge retention property and charge releasing property of the toner under various environmental conditions. According to the present inventors' study, it has been found that the ratio of tan δ ($10^5$ Hz) to tan δ ($5\times10^4$ Hz) most remarkably varies depending on environmental change. If the ratio is less than 1.05, charge of the toner would be significantly reduced depending on environmental change when changed from low temperature and low humidity conditions to high temperature and high humidity conditions. As a result, deterioration of development property would be caused. If the ratio exceeds 1.40, charge of the toner would be excessively increased depending on environmental change when changed from high temperature and high humidity conditions to low temperature and low humidity conditions. As a result, deterioration of development property would also be caused.

The ratio of the loss tangent tan δ at the frequency of $10^5$ Hz to that of $5\times10^4$ Hz is derived from the balance of charge giving property of the binder resin or the organometallic compound and charge releasing property of the carbon black in toner particles. Therefore, the relationship satisfying the above-mentioned equation indicates that the carbon black is extremely evenly dispersed in toner particles.

In the black toner of the present invention, it is sufficient that the carbon black is dispersed in toner particles in such a manner as to satisfy the above-mentioned loss tangents. More preferably, the carbon black dispersed in the toner particles has dispersed particle size of 0.50 μm or less, much more preferably of 0.45 μm or less and especially preferably of 0.40 μm or less. In such a case, it has been found that the toner is advantageous for charge stability or transferring property. Even if the carbon black having a small primary particle diameter is used, in the case where there exists insufficiently dispersed and relatively largely agglomerated carbon black having dispersed particle size of more than 0.50 μm, charge leakage due to conductivity of the carbon black would be easily caused and therefore charge stability tends to be deteriorated.

The dispersed particle size of the carbon black in the toner particles is determined by the following procedure. A picture of cross section of the toner particle is taken by a transmission electron microscope (TEM) in an enlarged form with a magnification of 40,000. Among the carbon black particles dispersed in the toner particle, a hundred of particles are selected at random and the particle size thereof is directly measured. The dispersed particle size is determined as average particle size using the distribution of the data on measurement results.

The black toner of the present invention preferably has peak temperature of maximum endothermic peak of 60 to 95° C. in an endothermic curve of differential scanning calorimetry (DSC) measurement. The peak temperature mainly represents a softening point of the releasing agent. If the peak temperature is less than 60° C., preservation property of the toner tends to be deteriorated. If the peak temperature exceeds 95° C., fixing property of the toner at a low temperature tends to be deteriorated.

Preferably, the black toner of the present invention has a molecular weight distribution whose main peak is in a range of 3,000 to 40,000 in gel permeation chromatography (GPC) of resin component being solved in tetrahydrofuran (THF) solvent, and has Mw/Mn of 70 or more. If the main peak in GPC is in the molecular weight range of less than 3,000, the toner may have insufficient hot offset resistance. If the main peak in GPC is in the molecular weight range of more than 40,000, the fixing property of the toner at a low temperature may be deteriorated. Furthermore, in the case of forming color image, glossiness would be deteriorated undesirably. If the Mw/Mn is less than 70, the fixing temperature range tends to be narrowed.

The carbon black employed in the present invention is not specifically limited and any commercially available carbon black can be used. The carbon black having primary particle diameter of 10 to 60 nm is preferred. In view of coloring property and dispersibility, the content of the carbon black contained in the toner particle is in the range of 2 to 10 parts by mass, preferably of 3 to 8 parts by mass based on 100 parts by mass of the resin component of the toner particle.

Hereinafter, the binder resin employed in the present invention will be described.

When polyester resin is employed as the binder resin, alcohol, and carboxylic acid, carboxylic anhydride, carboxylate or the like can be used as a raw material monomer.

Specifically, for example, as a dihydric alcohol component, alkylene oxide adducts of bisphenol A such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, a hydrogenated bisphenol A, and the like can be given.

As an alcohol component that is trivalent or more, for example, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1, 2,4-butanetriol, trimethylolethane, trimethylolpropane, and 1,3,5-trihydroxymethylbenzene can be given.

As an acid component, aromatic dicarboxylic acids such as phtalic acid, isophtalic acid, and terephtalic acid, and anhydrides thereof; alkyldicarboxylic acids such as succinic acid, adipic acid, sebacic acid, and azelaic acid, and anhydrides thereof; succinic acids substituted by an alkyl group having 6 to 12 carbon atoms, and anhydrides thereof; unsaturated dicarboxylic acids such as fumaric acid, maleic acid, and citraconic acid, and anhydrides thereof can be given.

Among them, in particular, polyester resin obtained by condensation polymerization using bisphenol derivative represented by the following general Formula (I) as a diol component and bivalent or more carboxylic acid, anhydride thereof or a carboxylic acid component of lower alkyl ester thereof as an acid component, is preferred because a color toner having excellent charging property can be obtained. Examples of the above-mentioned carboxylic acid component include fumaric acid, maleic acid, maleic anhydride, phthalic acid, terephthalic acid, trimellitic acid, and pyromellitic acid.

[Formula I]

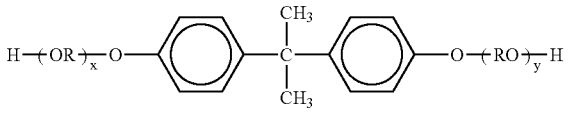

(wherein R represents ethylene group or propylene group, each of x and y is an integer number of 1 or more, and the mean value of x+y is 2 to 10).

When using a vinyl polymer as the binder resin, as the vinyl monomer for forming the vinyl polymer, the following can be given. Styrene; styrene derivatives such as o-methylstyrene, m-methylstyrene, p-methylstyrene, α-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene; unsaturated monoolefins such as ethylene, propylene, butylene, and isobutylene; unsaturated polyenes such as butadiene, and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalins; and acrylate or metacrylate derivatives such as acrylonitrile, methacrylonitrile, and acrylamide can be given.

Further, unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; unsaturated dibasic acid half esters such as maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenylsuccinic acid methyl half ester, fumaric acid methyl half ester, and mesaconic acid methyl half ester; unsaturated dibasic acid esters such as dimethylmaleate, and dimethyl fumarate; α,β-unsaturated acids such as acrylic acid, methacrylic acid, crotonic acid, and cinnamic acid; anhydrides of α,β-unsaturated acids such as crotonic anhydride and cinnamic anhydride; anhydrides of the above-mentioned α,β-unsaturated acids and lower aliphatic acids; and monomers each having a carboxyl group such as alkenylmalonic acid, alkenylglutaric acid, and alkenyladipic acid, acid anhydrides thereof and monoesters thereof can be given.

Further, acrylates or methacrylates such as 2-hydroxyethyl acrylate, 2-hydroxyethyl methacrylate, and 2-hydroxypropyl methacrylate; and monomers with hydroxy groups such as 4-(1-hydroxy-1-methylbutyl)styrene and 4-(1-hydroxy-1-methylhexyl)styrene can be given.

In the present invention, although the vinyl polymer as the binder resin may have a crosslinking structure crosslinked with a crosslinking agent having two or more vinyl groups. In this case, as the crosslinking agent used, aromatic divinyl compounds such as divinylbenzene, and divinlynaphthalene; diacrylate compounds bonded together with an alkyl chain such as ethylene glycoldiacrylate, 1,3-butyleneglycoldiacrylate, 1,4-butanediol diacrylate, 1,5-pentanediol diacrylate, 1,6-hexanediol diacrylate, neopentyl glycol diacrylate, and those obtained by changing the "acrylate" of each of the aforementioned compounds to "methacrylate"; diacrylate compounds bonded together with an alkyl chain containing an ether bond such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those obtained by changing the "acrylate" of each of the aforementioned compounds to "methacrylate"; and diacrylate compounds bonded together with a chain containing an aromatic group and an ether bond such as polyoxyethylene (2)-2,2-bis(4-hydroxyphenyl)propane diacrylate, polyoxyethylene(4)-2,2-bis(4-hydroxyphenyl)propane diacrylate, and those obtained by changing the "acrylate" of each of the aforementioned compounds to "methacrylate" can be given.

As a polyfunctional crosslinking agents, pentaerythritol triacrylate, trimethylolethane triacrylate, trimethylolpropane triacrylate, tetramethylolmethane tetraacrylate, oligoester acrylate, and those obtained by changing the "acrylate" of each of the aforementioned compounds to "methacrylate"; triallyl cyanurate, and triallyl trimellitate can be given.

As a polymerization initiators used for forming the vinyl polymer in the present invention, for example, 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutylate, 1,1'-azobis(1-cyclohexanecarbonitrile), 2-(carbamoylazo)-isobutyronitrile, 2,2'-azobis(2,4,4-trimethylpenthane), 2-phenylazo-2,4-dimethyl-4-methoxyvaleronitrile, 2,2'-azobis(2-methylpropane), ketone peroxides such as methyl ethyl ketone peroxide, acetylacetone peroxide, and cyclohexanone peroxide, 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, dicumyl peroxide, α, α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate can be given.

In the present invention, a resin containing a hybrid resin component can also be used as a binder resin. The hybrid resin component means a resin in which vinyl polymer unit and polyester resin unit are chemically bonded to each other. Specifically, the hybrid resin component can be formed by a transesterification of the polyester resin unit and the vinyl polymer unit such as acrylate or methacrylate which is obtained by polymerizing a monomer having carboxylate group. Preferably, the hybrid resin component is a graft copolymer obtained by using the vinyl polymer unit as a main component and the polyester resin unit as a branch component in the polymer or a block copolymer. The above-mentioned vinyl polymer and polyester resin can be used as the vinyl polymer unit and a polyester resin unit, respectively.

In the present invention, the hybrid resin component is preferably obtained by the following procedure: adding to the vinyl polymer and/or the polyester resin a monomer reactive with both of them, then conducting a polymerization reaction on at least one of the vinyl polymer and the polyester resin in the presence of the polymer containing the reactive monomer. Among monomers constituting the polyester resin unit, for example, unsaturated dicarboxylic acid such as phthalic acid, maleic acid, citraconic acid and itaconic acid, or anhydride thereof can be reacted with vinyl polymer unit. Among the monomers constituting the vinyl polymer unit, a monomer having carboxyl group or hydroxyl group, acrylate or methacrylate can be reacted with the polyester unit.

Typical examples of method of producing a binder resin containing a hybrid resin component employed in the black toner of the present invention include producing methods (1) to (6) as follows.

(1) The method includes blending the vinyl resin; the polyester resin and the hybrid resin component after respectively producing the vinyl resin, the polyester resin and the hybrid resin component. The blended product is obtained by being solved and swollen in organic solvent such as xylene and then removing the solvent with distillation. An ester compound obtained by the below-indicated method can be used as the hybrid resin component. The method includes independently producing a vinyl polymer unit and a polyester resin unit, solving and swelling the product in a small amount of organic solvent, adding esterified catalyst and alcohol, and heating so as to conduct transesterification for synthesis.

(2) The method includes producing a vinyl polymer unit and then producing a polyester resin unit and a hybrid resin component in the presence of the vinyl polymer unit. The hybrid resin component is produced by reaction of the vinyl polymer unit (optionally, vinyl monomer can be added thereto) with a polyester monomer (specifically, alcohol and carboxylic acid) and/or the polyester resin unit. In the method, organic solvent can be appropriately used.

(3) The method includes producing a polyester resin unit and then producing a vinyl polymer unit and a hybrid resin component in the presence of the polyester resin unit. The hybrid resin component is produced by reaction of the polyester resin unit (optionally, polyester monomer can be added thereto) with the vinyl monomer and/or vinyl polymer unit.

(4) The method includes producing a vinyl polymer unit and a polyester resin unit, and then adding a vinyl monomer and/or a polyester monomer (specifically, alcohol and carboxylic acid) in the presence of the above polymer units so as to produce a hybrid resin component. In the method, the organic solvent can also be appropriately used.

(5) The method includes producing a hybrid resin component, and then adding a vinyl monomer and/or a polyester monomer (specifically, alcohol and carboxylic acid) to the hybrid resin component and conducting addition polymerization and/or condensation polymerization so as to produce a vinyl polymer unit and a polyester resin unit. In the method, the hybrid resin component obtained by the above-mentioned methods (2) to (4) can be used. If necessary, a hybrid resin component obtained by any known producing method can also be used. Furthermore, the organic solvent can be appropriately used.

(6) The method includes mixing a vinyl monomer and/or a polyester monomer (specifically, alcohol and carboxylic acid) and conducting addition polymerization and condensation polymerization simultaneously to produce a vinyl polymer unit, a polyester resin unit and a hybrid resin component. In the method, the organic solvent can also be appropriately used.

In the above-mentioned producing methods (1) to (5), a plurality of polymer units having different molecular weights and crosslinking degrees can be used as the vinyl polymer unit and/or the polyester resin unit.

As the binder resin contained in the toner of the present invention, mixture of the above-mentioned polyester resin and the above-mentioned vinyl polymer can be used.

As a binder resin contained in the toner of the present invention, a mixture of the above-mentioned hybrid resin component and the above-mentioned vinyl polymer can be used.

As the binder resin contained in the toner of the present invention, a mixture of the above-mentioned hybrid resin component and the above-mentioned polyester resin can be used.

As the binder resin contained in the toner of the present invention, a mixture in which the vinyl polymer is added to the above-mentioned polyester resin and the above-mentioned hybrid resin component can be used.

Furthermore, the carbon black employed in the present invention preferably has the average primary particle diameter of 13 to 55 nm, more preferably of 25 to 50 nm. If the average primary particle diameter is less than 13 nm, uniform dispersion would be difficult to be achieved and free carbon black on the toner particle surface would be easily caused. In contrast, when the average primary particle diameter of the carbon black exceeds 55 nm, the coloring property would be insufficient although the carbon black particles are uniformly dispersed. If a large amount of carbon black is used for improving the coloring property, the charge amount of the toner would be decreased.

Furthermore, the carbon black employed in the present invention preferably has DBP oil absorption of 20 to 100 ml/100 g, more preferably of 30 to 60 ml/100 g. If the DBP oil absorption exceeds 100 ml/100 g, migration of the carbon black to the toner surface tends to be caused. As a result, the transferring property and coloring property of the toner tend to be deteriorated especially under a high humidity condition. In contrast, the DBP oil absorption is less than 20 ml/100 g, the dispersibility of the carbon black in the toner particle would be insufficient. As a result, deterioration of the coloring property or charge amount of the toner tends to be caused.

Furthermore, the carbon black employed in the present invention preferably has pH of 7 or higher.

The releasing agent employed in the present invention is used for improving a releasing property between a fixed image and a fixing roller and any suitable releasing agent would be employed without particular limitations. Examples of the releasing agent include hydrocarbon wax such as low molecular weight polyethylene, a wax material such as microcrystalline wax, carnauba wax, Sasol wax, paraffin wax, ester wax, alcohol modified wax and urethane modified wax, and polyolefin. Also, a modified product thereof would be preferred. A wax having a low melting point with a peak temperature of maximum endothermic peak of 60 to 95° C. in an endothermic curve of DSC measurement would be preferred so as to improve the dispersibility of the carbon black.

Among the above-mentioned wax materials, styrene modified hydrocarbon wax having styrene unit and having a low melting point would be preferred so as to especially improve the dispersibility of the carbon black. Although the definitive reason is not clear, it is conceivable that: the styrene unit in the hydrocarbon wax improves compatibility not only with the carbon black but also with the binder resin, therefore, the binder resin, the carbon black and the releasing agent are finely dispersed in the toner particles. The content of the releasing agent employed in the present invention is preferably 1 to 20 parts by mass, more preferably 2 to 15 parts by mass based on 100 parts by mass of the toner because both fixing property and development property are satisfied.

The black toner of the present invention preferably contains a charge controlling agent so that the toner is capable of keeping the charges appropriately. As the charge controlling agent of negatively charging property, any known agent can be used without particular limitations. Preferably, the organometallic compound can be used, more preferably an aluminum compound of organic carboxylic acid can be used, and especially preferably, an aluminum compound of aromatic hydroxy carboxylic acid can be used. As described above, since the organometallic compound also improves dispersibility of the carbon black, it is especially preferably used. The content of the charge controlling agent employed in the present invention is preferably 0.1 to 7 parts by mass, more preferably 0.2 to 6 parts by mass based on 100 parts by mass of the toner because the dispersibility of the carbon black is improved and because the development property and charge stability against environmental change are satisfied.

Furthermore, the aluminum compound of aromatic oxycarboxylic acid not only functions as the charge controlling agent but also has an effect of crosslinking the binder resin during kneading in the case where the toner is produced by a pulverizing method. Therefore, the preservation property or fixing property of the toner is maintained even if shearing stress is increased during kneading.

The black toner of the present invention has weight-average particle diameter of 3.5 to 8.0 μm. The black toner of the present invention has characteristics that the carbon black is finely dispersed therein and that the total of acid value and hydroxyl value is relatively high. Therefore, although the toner has small particle size (specifically, weight-average particle diameter of 3.5 to 8.0 μm), the charging property and charge releasing property are satisfactorily balanced. As a result, stable image can be provided with a high definition. If the weight-average particle diameter of the toner exceeds 8.0 μm, this means the lack of small particles capable of contributing to forming high quality image. As a result, a minute electrostatic image on a photoconductive drum would be hardly developed with accuracy, reproducibility of a highlight part would be deteriorated, and furthermore, resolution may be deteriorated. In addition, excessive amount of toner tends to be fixed on an electrostatic image, resulting in an increase of toner consumption. In contrast, if the weight-average particle diameter of the toner is less than 3.5 μm, fogging especially under the low temperature and low humidity conditions tends to be caused probably due to unevenness of charge amount of the toner.

Furthermore, in order to attain high transfer efficiency, the black toner of the present invention has characteristics that an average circularity of particles contained in the toner having circle-equivalent diameter of 2 μm or more is 0.915 to 0.960, more preferably 0.925 to 0.955. If the average circularity is less than 0.915, flowability of the toner tends to be deteriorated since an effect of imparting the flowability by external additives is insufficient, charge amount of the toner would be uneven, and deterioration of transfer efficiency or toner scattering tends to be caused. In contrast, if the average circularity exceeds 0.960, a triboelectric charging amount of the toner would be insufficient. As a result, fogging would be easily caused. The average circularity can be controlled by sphering the toner particles.

Further, when the toner particles are subjected to the sphering treatment, attention should be paid to an exposure condition of the carbon black or the releasing agent on the surface of the toner particles. The detail of the sphering treatment will be described later.

The black toner of the present invention preferably contains a flowability improving agent externally added to the toner in view of improving the image quality.

Preferred examples of the flowability improving agent include inorganic fine powders such as fine powders of silicon oxide, titanium oxide, and aluminum oxide. More preferably, the flowability improving agent is hydrophobically treated by a hydrophobing agent such as silane coupling agent, silicone oil or mixture thereof.

The content of the flowability improving agent is preferably 0.5 to 5 parts by mass based on 100 parts by mass of the toner particles.

When the black toner of the present invention is used for forming a full-color image, titanium oxide fine powders are preferably used as the flowability improving agent. A mixing apparatus such as Henschel mixer is preferably used in mixing the toner particles and the flowability improving agent.

The black toner of the present invention is applicable to non-magnetic one-component development, non-magnetic two-component development or the like.

When the black toner according to the present invention is used as a two-component developer for non-magnetic two-component development, the black toner is used in combination with a magnetic carrier. Examples of the magnetic carrier include a metal particle such as surface oxidized or non-oxidized iron, nickel, copper, zinc, cobalt, manganese, chromium and rare-earth element, alloy particle and oxide particle thereof, and ferrite.

A coated carrier in which the surface of the above-mentioned magnetic carrier is coated with resin is especially preferably used for development in which an AC bias is applied to a developing sleeve. Any well-known suitable coating method can be applied. For example, a method which includes preparing a coating liquid by dissolving or suspending a coating material such as resin in solvent and applying the coating liquid onto the surface of magnetic carrier core particles, or a method which includes kneading magnetic carrier core particles and coating material in a pulverized form.

Examples of the coating material onto the magnetic carrier core particle surface include silicone resin, polyester resin, styrene resin, acrylic resin, polyamide, polyvinyl butyral, and amino acrylate resin. They can be used alone or in combination.

In the case where the black toner of the present invention and the magnetic carrier are blended so as to prepare the two-component developer, as a compounding ratio therebetween, the content of the toner in the developer is 2 to 15% by mass, preferably 4 to 13% by mass, so that satisfactory result can be generally obtained. If the content of the toner is less than 2% by mass, the image density tends to be insufficient. If the content of the toner exceeds 15% by mass, fogging or toner scattering in the apparatus tends to be caused.

Hereinafter, a method for producing the black toner of the present invention will be described.

A method for producing the black toner of the present invention is not specifically limited. Preferred examples thereof include a pulverizing method because the method provides strong shearing stress during kneading the materials to easily disperse the carbon black in the binder resin. Especially, in order to achieve more satisfactory dispersion of the carbon black, a method which includes repeating a so-called master batch step where the binder resin and the carbon black are kneaded in advance so as to improve affinity with each other.

Furthermore, as described above, the black toner of the present invention is preferably subjected to sphering treatment of pulverized fine particles. An apparatus as indicated below is exemplified, which enables the suitable sphering treatment.

Figure 2:
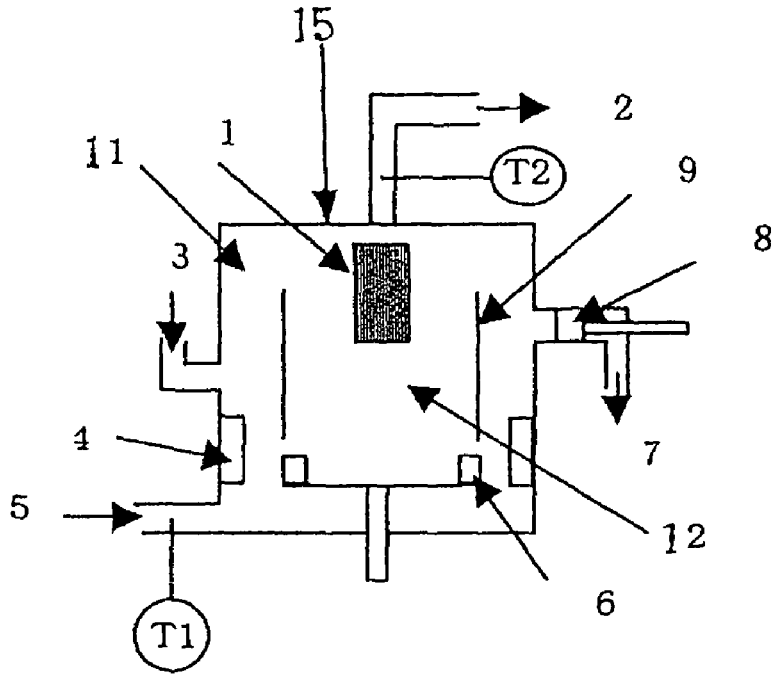
FIG. 2 is a schematic view illustrating an example of an apparatus modifying a toner surface in the present invention.

FIG. 2 is a schematic view showing an example of a surface modifying apparatus which can be used for producing the toner of the present invention.

The surface modifying apparatus as shown in FIG. 2 includes a casing 15, a jacket (not shown) which allows cooling water or antifreezing fluid to pass therethrough, a classifying rotor 1 as a classifier which divides particles into particles having larger particle size than the predetermined particle size and fine particles having smaller particle size than the predetermined particle size, a dispersing rotor 6 as a surface treating unit which applies a mechanical impact to the particles so as to perform surface treatment of the particles, a liner 4 circumferentially mounted in the casing 15 with a predetermined gap from an outer periphery of the dispersing rotor 6, a guide ring 9 as a guide unit that guides the particles divided by the classifying rotor 1 and having larger particle size than the predetermined particle size to the dispersing rotor 6, a discharging port for recovering fine particles 2 as a discharging unit that discharges the fine particles divided by the classifying rotor 1 and having smaller particle size than the predetermined particle size to the outside of the apparatus, a cooling air introducing port 5 as a particle circulating unit, which delivers the surface-treated particles by the dispersing rotor 6 to the classifying rotor 1, a material supplying opening 3 through which the particle to be treated is introduced into the casing 15, a particle outlet 7, which can be freely opened and closed, for discharging the surface-treated particles from the casing 15, and an outlet valve 8.

The classifying rotor 1 is a cylindrical rotor and mounted at one end side in the casing 15. The discharging port for recovering fine particles 2 is mounted at one end of the casing 15 so as to discharge the particles inside the classifying rotor 1. The material supplying opening 3 is mounted at the central portion on the peripheral surface of the casing 15. The cooling air introducing port 5 is mounted at another end side on the peripheral surface of the casing 15. The particle outlet 7 is mounted opposing to the material supplying opening 3 on the peripheral surface of the casing 15. The outlet valve 8 freely opens and closes the particle outlet 7.

Figure 3:
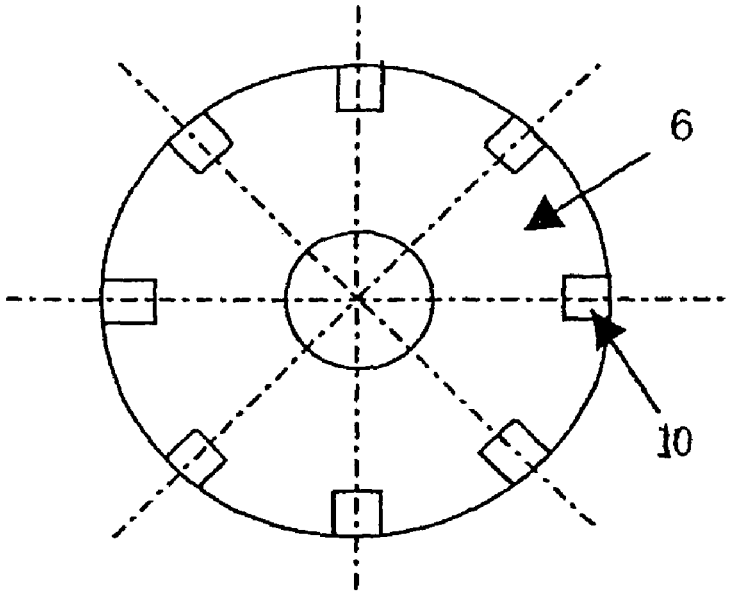
FIG. 3 is a schematic view illustrating an example of a dispersing rotor which constitutes a part of the apparatus shown in FIG. 2.

The dispersing rotor 6 and the liner 4 are mounted between the cooling air introducing port 5 and either the material supplying opening 3 or the particle outlet 7. The liner 4 is circumferentially mounted along the inner peripheral surface of the casing 15. As shown in FIG. 3, the dispersing rotor 6 includes a circular plate and a plurality of angular plates 10 placed on the outer periphery of the circular plate along the direction of the normal axis of the circular plate. The dispersing rotor 6 is mounted at another end side of the casing 15 and at the position at which the predetermined space is defined between the liner 4 and the angular plates 10. The center portion of the casing 15 is provided with the guide ring 9. The guide ring 9 has a cylindrical shape and is mounted so that one end of the ring overlaps a part of the outer peripheral surface of the classifying rotor 1 and another end thereof extends to the vicinity of the dispersing rotor 6. The guide ring 9 forms, in the casing 15, a first space 11 defined between the outer peripheral surface of the guide ring 9 and the inner peripheral surface of the casing 15, and a second space 12 defined as an inside space of the guide ring 9. The gap between the dispersing rotor 6 and the liner 4 is a surface modifying zone where the surface modification is performed, and the space defined by the classifying rotor 1 and its vicinity is a classifying zone where the particle classification is performed.

The dispersing rotor 6 may be provided with cylindrical pins in place of the angular plates 10. According to this embodiment, a number of grooves are formed on the surface of the liner 4 opposing the angular plates 10. However, the grooves are not necessarily formed on the surface in the present invention. Furthermore, the classifying rotor 1 may be vertically mounted as shown in FIG. 2 or may be horizontally mounted. In addition, single classifying rotor 1 may be employed as shown in FIG. 2 or the plural classifying rotors may also be employed.

According to the surface modifying apparatus as described above, the surface modification is carried out as follows. A certain amount of the pulverized material is fed through the material supplying opening 3 while the outlet valve 8 is closed. The fed material is vacuumed by a blower (not shown) and classified by the classifying rotor 1. The classified fine particles having smaller particle size than the predetermined particle size pass through the classifying rotor 1 on its periphery so as to be introduced to the inside of the classifying rotor 1 and continuously discharged to the outside of the apparatus for the removal. The coarse particles having larger particle size than the predetermined particle size are carried with a circulating flow produced by the dispersing rotor 6 so as to be guided to the space between the angular plates 10 and the liner 4 (hereinafter, also referred to as "the surface modifying zone"). At that time, the particles are moved along the inner periphery of the guide ring 9 (the second space 12) by centrifugal force. The material of particles guided to the surface modifying zone is subjected to a mechanical impact at the space between the dispersing rotor 6 and the liner 4 so that the surface modification is carried out. The surface-modified particles after the surface modification are carried with cool air flow along the outer periphery of the guide ring 9 (the first space 11) to the classifying rotor 1 and guided to the classifying zone. Then, the fine particles are discharged to the outside of the apparatus by the classifying rotor 1. In contrast, the coarse particles are carried back to the second space 12 with the circulating flow so as to be subjected to the surface modification in the surface modifying zone repeatedly. As described above, according to the surface modifying apparatus as shown in FIG. 2, the particle classification by the classifying rotor 1 and the particle surface treatment by the dispersing rotor 6 are repeatedly carried out. After a certain time period has passed, the outlet valve 8 is set to be open and the surface-modified particles are collected through the particle outlet 7. In the present invention, upon the cooling, a temperature of the apparatus is not specifically defined. Preferably, the surface-modified particles are preferably discharged at the temperature of 45° C. or less so as to avoid wax migration to the surface of the surface-modified particles.

The above-mentioned apparatus is very much preferred because migration of the releasing agent to the toner surface due to heat is remarkably suppressed and because sphering treatment of the toner particles and migration control of the releasing agent are easily performed, compared to the conventional apparatus which applies a mechanical impact while pulverizing the particles. Furthermore, according to the above-mentioned apparatus, exposure of the carbon black on the toner surface is suppressed.

Hereinafter, a method of measuring physical properties of the black toner of the present invention will be described.

<Measurement of Weight-Average Particle Diameter of Toner>

A weight-average particle diameter of a toner is measured using Coulter Multisizer II (manufactured by Beckman Coulter, Inc.) equipped with an interface (manufactured by Nikkaki-bios K. K.) which outputs number distribution and volume distribution and with PC-9801 personal computer (manufactured by NEC Corporation). As an electrolyte, a 1% NaCl aqueous solution is prepared using primary reagent grade sodium chloride. For example, ISOTON R-II (manufactured by Coulter Scientific Japan, Ltd.) can be used. A measuring method is as follows. 0.1 to 5 ml of a surfactant (preferably alkyl benzene sulfonate) as a dispersing agent is added to 100 to 150 ml of the above-mentioned electrolyte. Furthermore, 2 to 20 mg of a sample to be measured is added thereto. The electrolyte in which the sample is suspended is subjected to dispersing treatment for approximately 1 to 3 minutes with an ultrasonic disperser. The volume and the number of toner having particle diameter of 2 μm or more are measured using the above-mentioned Coulter Multisizer with a 100 μm aperture to calculate the number distribution and the volume distribution. Using thus-obtained values, the weight-average particle diameter of a toner based on weight (in which a central value in each channel is regarded as a representative value for each channel) is determined.

<Method for Measuring Dielectric Constant and Loss Tangent of Toner>

Using 4284A Precision LCR Meter (manufactured by Hewlett-Packard Company), calibration is performed at frequencies of 1 kHz and 1 MHz.

0.5 to 0.7 g of toner is weighed and a load of 34,300 kPa (350 kgf/cm$^2$) is applied thereon for two minutes so as to prepare a disc-like sample having a diameter of 25 mm and a thickness of 1 mm or less (preferably 0.5 to 0.9 mm). The sample is fixed to ARES (manufactured by TA Instruments Corporation) mounted with a jig (electrode) for measuring dielectric constant, which has a diameter of 25 mm. Then, the measurement is performed at ordinary temperature (23° C.) with a load of 0.98 N (100 g) being applied to the sample.

Measurement of a loss tangent tan δ in a frequency range of $10^3$ to $10^4$ Hz is performed as follows: tan δ at the frequency of every 1000 Hz in the range of $10^3$ to $10^4$ Hz (i.e., at ten points) is measured three times respectively to calculate a mean value at each frequency point.

In the present invention, satisfaction of the following equation means that all of the mean values at the above-mentioned ten points are 0.0060 or less.

$$\tan\delta(10^3 \text{ to } 10^4 \text{ Hz}) \leqq 0.0060$$

Regarding the ratio of tan δ ($10^5$ Hz) to tan δ ($5\times10^4$ Hz) represented by tan δ ($10^5$ Hz)/tan δ ($5\times10^4$ Hz), tan δ ($10^5$ Hz) and tan δ ($5\times10^4$ Hz) are respectively measured three times and the ratio is calculated using the respective mean values.

<Method for Measuring Acid Value and Hydroxyl Value>

(Measurement of Acid Value)

The measurement is carried out in accordance with JIS K 0070-1966. Specifically, 2 to 10 g of toner is weighed in a 200 to 300 ml of Erlenmeyer flask and approximately 50 ml of mixed solvent containing 30/70 of methanol/toluene is added thereto to solve resin. If the resin is not solved sufficiently, a small amount of acetone can be added. Titration is performed using 0.1 mol/l of potassium hydroxide/alcohol solution which is standardized in advance as a titrant and using mixed indicator of 0.1% of bromthymol blue and phenol red as an indicator. Acid value is calculated using a consumption amount of the potassium hydroxide/alcohol solution and the following equation:

$$\text{Acid value}=\text{KOH(ml)}\times N\times 56.1/\text{sample mass}$$

In the above equation, N denotes a factor of 0.1 mol/l of KOH.

(Measurement of Hydroxyl Value)

The measurement is carried out in accordance with JIS K 0070-1966. Specifically, 2 to 5 g of toner is precisely weighed in a 100 ml of eggplant flask and 5 ml of acetylating reagent is correctly added thereto. Then, the flask is heated in water bath at 100° C.±5° C. After 1 to 2 hours, the flask is taken out from the bath and left to be cooled. Then, water is added thereto and the flask is swung to decompose acetic anhydride. Furthermore, the flask is again heated in the water bath for 10 minutes or more in order to complete the decomposition, then taken out and left to be cooled. Thereafter, wall of the flask is well washed with an organic solvent. Thus-obtained fluid is subjected to potentiometric titration using a glass electrode and 0.5 mol/l of potassium hydroxide/ethanol solution, to thereby obtain hydroxyl value.

<Peak Temperature of Maximum Endothermic Peak in DSC Endothermic Curve of Toner>

The measurement is performed using a differential scanning calorimeter (DSC measuring apparatus) DSC-7 (manufactured by Perkin-Elmer, Inc.) as follows.

2 to 10 mg, preferably 5 mg, of sample to be measured is precisely weighed. The weighed sample is put in an aluminum pan and an empty aluminum pan is used as a reference. The measurement is performed under ordinary temperature and humidity condition, at a heating rate of 10° C./min in the measurement temperature range of 30 to 200° C. During the heating step, a heat absorbing peak as maximum endothermic peak of DSC curve in the temperature range of 30 to 200° C. is obtained.

<GPC Measurement>

A molecular weight from chromatogram by gel permeation chromatography (GPC) is measured under the following conditions.

A column is stabilized in a heat chamber of 40° C. and tetrahydrofuran (THF) as a solvent is made to flow through the column at a flow rate of 1 ml/min. As a sample to be measured, approximately 50 to 200 μl of resin/THF solution whose concentration is 0.05 to 0.6% by mass is injected into the column. In molecular weight measurement of the sample, a molecular weight distribution of the sample is calculated from the relationship between a logarithmic value of a calibration curve made by using several kinds of mono-dispersed polystyrene standard samples and a count number (a retention time). As the polystyrene standard sample for making the calibration curve, for example, samples having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, which are produced by TOSOH Corporation or Pressure Chemical Corporation, are used. It is appropriate to use at least ten polystyrene standard samples. An RI (refractive index) detector is used as a detector.

The combination of commercially available polystyrene gel columns is preferably used in order to precisely carry out the measurement in the molecular weight range of $10^3$ to $2\times10^6$. For example, the combination selected from Shodex GPC KF-801, 802, 803, 804, 805, 806, and 807, which are produced by Showa Denko K.K., and the combination selected from μ-styragel 500, 103, 104, and 105, which are produced by Waters Corporation, may be used.

<Measurement of Average Circularity>

A circularity in the present invention represents unevenness of toner particles. The circularity is 1.000 when the toner particle has a perfect spherical shape. The more surface unevenness is, the smaller the circularity is. In the present invention, the measurement is performed using a flow type particle image measuring apparatus FPIA-2100 model (manufactured by Sysmex Corporation) and the circularity is calculated by the following equations:

Circularity $c$=Circumference length of the circle having the same area as a project area of the particle/Circumference length of a project image of the particle $$\text{Average circularity}=\Sigma(c_i/m)$$

Here, the term "project area of the particle" means a binarized image area of the toner particle and the term "circumference length of a project image of the particle" means length of an outline obtained by connecting each edge point of the image of the toner particle.

A specific measuring method is as follows: 10 ml of ion-exchanged water from which solid impurities and the like are removed in advance is prepared in a container. A surfactant, preferably alkyl benzene sulfonate, as a dispersing agent is added thereto, and then, 0.02 g of the sample to be measured is added and evenly dispersed therein. Dispersing treatment is performed for 2 minutes using an ultrasonic disperser Tetoral 150 model (manufactured by Nikkaki-bios K.K.), to thereby obtain a dispersion sample. During the treatment, the dispersion is appropriately cooled such that the temperature thereof is kept less than 40° C.

Measurement of the shape of the toner particle is carried out, using the flow type particle image measuring apparatus, as follows: the concentration of the above-mentioned dispersion is readjusted such that the toner particle concentration at the measurement is 3,000 to 10,000 particles/μl.

Then, 1,000 or more of the toner particles are measured. After the measurement, the average circularity is obtained using the measured data while the data of the particle diameter of 2 μm or less is omitted.

The measuring apparatus FPIA-2100 used in the present invention has superior precision of the toner shape measurement compared to an apparatus FPIA-1000 conventionally used for calculating the shape of the toner. This is because: sheath flow (i.e., cell thickness when the sample fluid is made to flow between a CCD camera and a stroboscope) is made thinner; magnification of the measured particle image is improved; and resolution of the saved image is improved (specifically, from 256×256 to 512×512). As a result, the apparatus achieves more precise analysis of finer particles.

EXAMPLES

Hereinafter, specific examples of the present invention will be described. However, the present invention is not limited to these examples.

Production Example 1 of Hybrid Resin 2.0 mol of styrene, 0.21 mol of 2-ethylhexylacrylate, 0.16 mol of fumaric acid, and 0.03 mol of α-methyl styrene dimer as monomers for vinyl polymer unit, and 0.05 mol of dicumylperoxide as a polymerization initiator were put in a dropping funnel. On the other hand, 7.0 mol of poly (oxypropylene) (2.2)-2,2-bis(4-hydroxyphenyl)propane, 3.0 mol of poly (oxyethylene) (2.2)-2,2-bis(4-hydroxyphenyl) propane, 3.0 mol of terephthalic acid, 2.0 mol of trimellitic anhydride, and 5.0 mol of fumaric acid as monomers for polyester resin unit, and 0.2 g of dibutyltin oxide as a catalyst were put in 4-liter of four-necked flask made of glass. A thermometer, a stirrer, a condenser, and a nitrogen introducing tube were attached to the flask and the flask was put in a mantle heater.

Next, a nitrogen gas was introduced into the flask so as to make nitrogen atmosphere in the flask, and then the flask was gradually heated while being stirred. Then, the monomer composition in the above-mentioned dropping funnel was dropped to the flask for 4 hours while the system was kept at 140° C. with being stirred. Thereafter, the reaction mixture was heated to 200° C. and the reaction was carried out for 4 hours at that temperature to obtain a hybrid resin 1. The results of molecular weight measurement by GPC are shown in Table 1.

TABLE 1

| | Acid value (mgKOH/g) | Hydroxyl value (mgKOH/g) | Results of molecular weight measurement (GPC) | | | |
|---|---|---|---|---|---|---|
| | | | Main peak in molecular weight range | Mw | Mn | Mw/Mn |
| Hybrid resin 1 | 30.5 | 28.4 | 15300 | 83100 | 3000 | 28.1 |
| Polyester resin | 39.1 | 40.4 | 6200 | 25500 | 3100 | 8.2 |
| Vinyl resin | 18.3 | — | 8200 | 10000 | 3500 | 2.9 |
| Hybrid resin 2 | 18.2 | 7.1 | 6500 | 14000 | 3100 | 4.5 |
| Hybrid resin 3 | 42.4 | 39.3 | 14600 | 25000 | 3100 | 8.1 |

Production Example 2 of Hybrid Resin 15 mol % of benzoic acid were added to polyester (1) obtained from 34 mol % of terephthalic acid, 4 mol % of fumaric acid, 38 mol % of poly (oxyethylene) (2.2)-2,2-bis (4-hydroxyphenyl)propane, 7 mol % of poly (oxypropylene) (2.2)-2,2-bis(4-hydroxyphenyl)propane, and 2 mol % of trimellitic anhydride to produce end-capped polyester (A-1) in which a hydroxyl group at the end of polyester molecule is end-capped. 100 parts by mass of the end-capped polyester (A-1) and 200 parts by mass of xylene were charged into a reaction container equipped with a ref lux condenser, a stirrer, a thermometer, a nitrogen introducing tube, a dropping device, and a pressure reducing device. The inside of the container was heated to 115 to 120° C. while introducing nitrogen to dissolve the polyester in xylene.

Then, a monomer composition containing 69 parts by mass of styrene, 21 parts by mass of butyl acrylate, and 10 parts by mass of monobutyl maleate as monomers for vinyl polymer unit and 4 parts by mass of di-t-butylperoxide as a polymerization initiator was added to the above-mentioned xylene solution to conduct a radical polymerization reaction for 8 hours. Then, xylene was removed by distillation under reduced pressure to thereby obtain the hybrid resin 2 in which unsaturated polyester is grafted with vinyl polymer. The results of molecular weight measurement by GPC are shown in Table 1.

Production Example 3 of Hybrid Resin 100 parts by mass of polyester obtained from 40 mol % of terephthalic acid, 4 mol % of fumaric acid, 23 mol % of poly (oxyethylene) (2.2)-2,2-bis(4-hydroxyphenyl)propane, and 23 mol % of poly (oxypropylene) (2.2)-2,2-bis (4-hydroxyphenyl)propane, were charged into a reaction container equipped with a reflux condenser, a stirrer, a thermometer, a nitrogen introducing tube, a dropping device, and a pressure reducing device, together with 200 parts by mass of xylene. The inside of the container was heated to 115 to 120° C. while introducing nitrogen to dissolve the polyester in xylene.

Then, the hybrid resin 3 was obtained in the same manner as in Production Example 2 of hybrid resin, except that a monomer composition containing 53 parts by mass of styrene, 15 parts by mass of butyl acrylate, and 4 parts by mass of monobutyl maleate as monomers for vinyl polymer unit and 1.5 parts by mass of di-t-butylperoxide as a polymerization initiator was used. The results of molecular weight measurement by GPC are shown in Table 1.

Production Example of Polyester Resin

First, 3.5 mol of poly (oxypropylene) (2.2)-2,2-bis(4-hydroxyphenyl)propane, 1.5 mol of poly (oxyethylene)

(2.2)-2,2-bis(4-hydroxyphenyl)propane, 1.5 mol of terephthalic acid, 1.0 ml of trimellitic anhydride and 2.5 mol of fumaric acid and 0.1 g of dibutyltin oxide were put in 4-liter of four-necked flask made of glass. A thermometer, a stirrer, a condenser, and a nitrogen introducing tube were attached to the flask and the flask was put in a mantle heater. The reaction was carried out over 5 hours under nitrogen atmosphere at 220° C. to obtain the polyester resin. The results of molecular weight measurement by GPC are shown in Table 1.

Production Example of Vinyl Polymer 200 parts by mass of xylene was heated to 120° C. while being stirred in a nitrogen atmosphere in a four-necked flask. Then, 73 parts by mass of styrene, 24 parts by mass of n-butyl acrylate, 3 parts by mass of methacrylic acid, and 4 parts by mass of di-t-butylperoxide were dropped to the flask for 3.5 hours. Furthermore, the polymerization was completed under xylene reflux and the solvent was removed by distillation under reduced pressure. As a result, the vinyl polymer was obtained. The results of molecular weight measurement by GPC are shown in Table 1.

Hereinafter, production examples of toner particles will be described. Toner particles 0 to 11 were prepared by the following methods.

Toner Particle Production Example 1

(First Kneading Step)

The below-indicated raw materials were charged in a kneader typemixer and heated while being blended without being pressurized.

| | |
|---|---|
| Paraffin wax grafted with styrene (styrene modified rate: 30% by mass, DSC peak temperature: 77° C., Mw: 1,500, Mn: 1,300, main peak in molecular weight range: 1,400) | 6 parts by mass |
| Carbon black (average primary particle diameter: 25 nm, DBP oil absorption: 95 ml/100 g, pH: 9) | 5 parts by mass |

The materials were melted and kneaded for 30 minutes while temperature of the material itself being kept at 110° C. and then was cooled. Furthermore, the resultant mixture was briefly pulverized to obtain a pulverized mixture.

(Second Kneading Step)

The below-indicated raw materials were charged in a kneader typemixer and heated while being blended without being pressurized.

| | |
|---|---|
| The pulverized mixture from the first step | 11 parts by mass |
| The above-mentioned hybrid resin 1 | 20 parts by mass |

The materials were melted and kneaded for 15 minutes while temperature of the material itself being kept at 110° C., and then was cooled after completion of the second step. Furthermore, the resultant mixture was pulverized to obtain a pulverized mixture.

(Third Kneading Step)

The below-indicated raw materials were charged in a kneader typemixer and heated while being blended without being pressurized.

| | |
|---|---|
| The pulverized mixture from the second step | 31 parts by mass |
| Aluminum compound of di-t-butyl salicylate (charge controlling agent) | 2.5 parts by mass |

The materials were melted and kneaded for 30 minutes while temperature of the material itself being kept at 110° C., and then was cooled after completion of the third step. Furthermore, the resultant mixture was pulverized to obtain a pulverized mixture.

(Fourth Kneading Step)

The below-indicated materials were sufficiently blended in advance by a Henschel mixer and were melted and kneaded by a twin-screw extruder kneading machine while temperature of the material itself being kept at 110° C. The resultant mixture was cooled and roughly crushed into a particle size of approximately 1 to 2 mm with a hammer crusher. Then, the mixture was finely pulverized into a particle size of 15 μm or less with an air jet type pulverizing machine.

| | |
|---|---|
| The pulverized mixture from the third step | 33.5 parts by mass |
| The above-mentioned hybrid resin 1 | 80 parts by mass |

Furthermore, the resultant pulverized mixture was subjected to surface treatment using an apparatus as shown in FIGS. 2 and 3. The surface treatment was carried out for 20 minutes while rotation speed of the classifying rotor is set to be 7,300 rpm to remove fine powders and rotation speed of the dispersing rotor is set to be 5,800 rpm (i.e., circumferential speed at the end of the rotor of 130 m/sec), in which one series of the surface treatment (specifically, one series includes feeding the pulverized mixture from the material supplying opening 3, performing the treatment for 45 seconds, and opening the outlet valve 8 to take out the treated particle) takes approximately 45 seconds. Ten of the angular plates were mounted on the dispersing rotor. The space between the guide ring and the angular plates on the dispersing rotor was set to be 30 mm and the space between the dispersing rotor and the liner was set to be 5 mm. Furthermore, a flow rate of a blower was set to be 14 $m^3$/min and temperature T1 of cooling medium and cooling air was set to be −20° C. As a result of 20-minute operation under the above-mentioned conditions, temperature T2 at the back of the classifying rotor was stabled at 27° C. and a toner particle 1 having a weight-average particle diameter of 6.2 μm and an average circularity of 0.939.

Toner Particle Production Example 2

(First Kneading Step)

The below-indicated raw materials were charged in a kneader typemixer and heated while being blended without being pressurized.

| | |
|---|---|
| Ester wax (behenyl behenate, DSC peak temperature: 72° C., Mw: 600, Mn: 520, main peak in molecular weight range: 570) | 6 parts by mass |
| Carbon black (average primary particle diameter: 25 nm, DBP oil absorption: 90 ml/100 g, pH: 9) | 5 parts by mass |

-continued

| | |
|---|---|
| Aluminum compound of di-t-butyl salicylate (charge controlling agent) | 2.5 parts by mass |

The above-mentioned hybrid resin 1 40 parts by mass

The materials were melted and kneaded for 30 minutes while temperature thereof being kept at 100° C. to complete the first step. Then, the resultant mixture was cooled and pulverized to obtain a pulverized mixture.

(Second Kneading Step)

The below-indicated materials were sufficiently blended in advance by a Henschel mixer and were melted and kneaded by a twin-screw extruder kneading machine while temperature thereof being kept at 130° C. The resultant mixture was cooled and roughly crushed into a particle size of approximately 1 to 2 mm with a hammer crusher. Then, the mixture was finely pulverized into a particle size of 15 μm or less with an air jet type pulverizing machine.

| | |
|---|---|
| The pulverized mixture from the first step | 53.5 parts by mass |
| The above-mentioned hybrid resin 1 | 60 parts by mass |

Furthermore, the resultant pulverized mixture was classified using the same apparatus as in Toner Particle Production Example 1 to obtain a toner particle 2.

Toner Particle Production Example 3

(Second Kneading Step)

The below-indicated raw materials were charged in a kneader typemixer and heated while being blended without being pressurized.

| | |
|---|---|
| The pulverized mixture obtained in the first step of Toner Particle Production Example 1 | 11 parts by mass |
| The above-mentioned polyester resin | 50 parts by mass |

The materials were melted and kneaded for 15 minutes while temperature thereof being kept at 110° C. to complete the second step. Then, the resultant mixture was cooled and pulverized to obtain a pulverized mixture.

(Third Kneading Step)

The below-indicated raw materials were charged in a kneader typemixer and heated while being blended without being pressurized.

| | |
|---|---|
| The pulverized mixture from the second step | 61 parts by mass |
| Aluminum compound of di-t-butyl salicylate (charge controlling agent) | 2.5 parts by mass |

The materials were melted and kneaded for 30 minutes while temperature thereof being kept at 110° C. to complete the third step. Then, the resultant mixture was cooled and pulverized so as to obtain a pulverized mixture.

(Fourth Kneading Step)

The below-indicated materials were sufficiently blended in advance by a Henschel mixer and were melted and kneaded by a twin-screw extruder kneading machine while temperature thereof being kept at 130° C. The resultant mixture was cooled and roughly crushed into a particle size of approximately 1 to 2 mm with a hammer crusher. Then, the mixture was finely pulverized into a particle size of 15 μm or less with an air jet type pulverizing machine.

| | |
|---|---|
| The pulverized mixture from the third step | 63.5 parts by mass |
| The above-mentioned vinyl resin | 50 parts by mass |

Furthermore, the resultant pulverized mixture was classified using the same apparatus as in Toner Particle Production Example 1 to obtain a toner particle 3.

Toner Particle Production Example 4

(First Kneading Step)

The below-indicated raw materials were charged in a kneader typemixer and heated while being blended without being pressurized.

| | |
|---|---|
| Normal paraffin wax (DSC peak temperature: 79° C., Mw: 620, Mn: 550, main peak in molecular weight range: 590) | 6 parts by mass |
| Carbon black (average primary particle diameter: 25 nm, DBP oil absorption: 90 ml/100 g, pH: 9) | 5 parts by mass |
| The above-mentioned polyester resin | 20 parts by mass |

The materials were melted and kneaded for 30 minutes while temperature thereof being kept at 100° C. Thereafter, the resultant mixture was cooled and briefly pulverized to obtain a pulverized mixture.

(Second Kneading Step)

The below-indicated raw materials were charged in a kneader typemixer and heated while being blended without being pressurized.

| | |
|---|---|
| The pulverized mixture from the second step | 31 parts by mass |
| The above-mentioned hybrid resin 1 | 20 parts by mass |
| Aluminum compound of di-t-butyl salicylate (charge controlling agent) | 2.5 parts by mass |

The materials were melted and kneaded for 30 minutes while temperature thereof being kept at 110° C. to complete the third step. Then, the resultant mixture was cooled and pulverized to obtain a pulverized mixture.

(Third Kneading Step)

The below-indicated materials were sufficiently blended in advance by a Henschel mixer and were melted and kneaded by a twin-screw extruder kneading machine while temperature thereof being kept at 130° C. The resultant mixture was cooled and roughly crushed into a particle size of approximately 1 to 2 mm with a hammer crusher. Then, the mixture was finely pulverized into a particle size of 15 μm or less with an air jet type pulverizing machine.

| | |
|---|---|
| The pulverized mixture from the second step | 53.5 parts by mass |
| The above-mentioned hybrid resin 1 | 60 parts by mass |

Furthermore, the resultant pulverized mixture was classified using the same apparatus as in Toner Particle Production Example 1 to obtain a toner particle 4.

Toner Particle Production Example 5

The below-indicated raw materials were charged in a kneader typemixer and heated while being blended without being pressurized.

| | |
|---|---|
| Carbon black (average primary particle diameter: 25 nm, DBP oil absorption: 90 ml/100 g, pH: 9) | 5 parts by mass |
| The above-mentioned hybrid resin 1 | 20 parts by mass |

The materials were melted and kneaded for 15 minutes while temperature thereof being kept at 100° C. Thereafter, the resultant mixture was cooled and briefly pulverized to obtain a pulverized mixture.

(Second Kneading Step)

The below-indicated materials were sufficiently blended in advance by a Henschel mixer and were melted and kneaded by a twin-screw extruder kneading machine while temperature thereof being kept at 130° C. The resultant mixture was cooled and roughly crushed into a particle size of approximately 1 to 2 mm with a hammer crusher. Then, the mixture was finely pulverized into a particle size of 15 μm or less with an air jet type pulverizing machine.

| | |
|---|---|
| The pulverized mixture from the first step | 45 parts by mass |
| Vinyl resin | 60 parts by mass |
| Ester wax (behenyl behenate, DSC peak temperature: 72° C., Mw: 600, Mn: 520, main peak in molecular weight range: 570) | 6 parts by mass |
| Aluminum compound of di-t-butyl salicylate (charge controlling agent) | 2.5 parts by mass |

Furthermore, the resultant pulverized mixture was classified using the same apparatus as in Toner Particle Production Example 1 to obtain a toner particle 5.

Toner Particle Production Example 6

The below-indicated materials were sufficiently blended in advance by a Henschel mixer and were melted and kneaded by a twin-screw extruder kneading machine while temperature thereof being kept at 130° C. The resultant mixture was cooled and roughly crushed into a particle size of approximately 1 to 2 mm with a hammer crusher. Then, the mixture was finely pulverized into a particle size of 10 μm or less with an air jet type pulverizing machine.

| | |
|---|---|
| The above-mentioned hybrid resin 1 | 100 parts by mass |
| Normal paraffin wax (DSC peak temperature: 79° C., MW: 620, Mn: 550, main peak in molecular weight range: 590) | 6 parts by mass |
| Carbon black (average primary particle diameter: 25 nm, DBP oil absorption: 90 ml/100 g, pH: 9) | 5 parts by mass |
| Aluminum compound of di-t-butyl salicylate (charge controlling agent) | 2.5 parts by mass |

Furthermore, the resultant pulverized mixture was classified using the same apparatus as in Toner Particle Production Example 1 to obtain a toner particle 6.

Toner Particle Production Example 7

In Toner Particle Production Example 6, pulverization pressure of air jet and rpm of the dispersing rotor of the apparatus for processing a pulverized mixture were raised to obtain a toner particle 7.

Toner Particle Production Example 8

The below-indicated materials were sufficiently blended in advance by a Henschel mixer and were melted and kneaded by a twin-screw extruder kneading machine while temperature thereof being kept at 130° C. The resultant mixture was cooled and roughly crushed into a particle size of approximately 1 to 2 mm with a hammer crusher. Then, the mixture was finely pulverized into a particle size of 25 μm or less with an air jet type pulverizing machine.

| | |
|---|---|
| The above-mentioned hybrid resin 1 | 10 parts by mass |
| The above-mentioned vinyl resin | 90 parts by mass |
| Carbon black (average primary particle diameter: 25 nm, DBP oil absorption: 90 ml/100 g, pH: 9) | 3 parts by mass |
| Polyethylene wax (DSC peak temperature: 122° C., MW: 2,000, Mn: 1,500, main peak in molecular weight range: 1,800) | 6 parts by mass |

Furthermore, the resultant pulverized mixture was air-classified using the same apparatus as in Toner Particle Production Example 1 to obtain a toner particle 8.

Toner Particle Production Example 9

The below-indicated materials were sufficiently blended in advance by a Henschel mixer and were melted and kneaded by a twin-screw extruder kneading machine while temperature thereof being kept at 130° C. The resultant mixture was cooled and roughly crushed into a particle size of approximately 1 to 2 mm with a hammer crusher. Then, the mixture was finely pulverized into a particle size of 10 μm or less with an air jet type pulverizing machine.

| | |
|---|---|
| The above-mentioned polyester resin | 100 parts by mass |
| Polyethylene wax (DSC peak temperature: 122° C., Mw: 2,000, Mn: 1,500, main peak in molecular weight range: 1,800) | 6 parts by mass |
| Carbon black (average primary particle diameter: 25 nm, DBP oil absorption: 90 ml/100 g, pH: 9) | 11 parts by mass |
| Boron compound of benzilic acid (charge controlling agent) | 8 parts by mass |

Furthermore, the resultant pulverized mixture was air-classified using the same apparatus as in Toner Particle Production Example 1 to obtain a toner particle 9.

Toner Particle Production Example 10

In Toner Particle Production Example 1, the hybrid resin 2 was used instead of the hybrid resin 1 to obtain a toner particle 10.

Toner Particle Production Example 11

In Toner Particle Production Example 1, the hybrid resin 3 was used instead of the hybrid resin 1 to obtain a toner particle 11.

1.0 part by mass of hydrophobic titanium oxide (BET specific surface: 110 $m^2/g$), which had been treated with $n\text{-}C_4H_9Si(OCH_3)_3$, was added to 100 parts by mass of each toner particle of the above-mentioned toner particles 1 to 11 using a Henschel mixer to obtain toners 1 to 11, respectively. Furthermore, the toners 1 to 11 were respectively blended with a magnetic ferrite carrier particle (a volume-average particle diameter: 50 μm), whose surface had been coated with silicone resin, such that the toner content is 6% by mass, to thereby obtain two-component developers 1 to 11, respectively.

Composition of the respective toners is shown in Table 2. Further, acid value, hydroxyl value, maximum peak temperature in DSC endothermic curve, and a molecular weight distribution by GPC using THF extraction of each toner are shown in Table 3. In addition, a weight-average particle diameter and an average circularity of each toner, a dispersed particle size of the carbon black in the toner particles, a maximum value of loss tangents tan δ ($10^3$ to $10^4$ Hz) in the frequency range of $10^3$ to $10^4$, values of loss tangents tan δ at the frequency of $5\times10^4$ Hz and $10^5$ Hz, and the ratio of tan δ ($10^5$ Hz) to tan δ ($5\times10^4$ Hz) are shown in Table 4.

TABLE 2

| | Resin (part) | Carbon black (part) | Releasing agent (part) | Charge controlling agen (part) |
|---|---|---|---|---|
| Toner 1 | Hybrid resin 1 (100) | 5 | Paraffin wax grafted with styrene (6) | Aluminum compound of di-t-butyl salicylate (2.5) |
| Toner 2 | Hybrid resin 1 (100) | 5 | Ester wax (6) | Aluminum compound of di-t-butyl salicylate (25) |
| Toner 3 | Polyester resin (50) Vinyl resin (50) | 5 | Paraffin wax grafted with styrene (6) | Aluminum compound of di-t-butyl salicylate (2.5) |
| Toner 4 | Hybrid resin 1 (80) Polyester resin (20) | 5 | Paraffin wax (6) | Aluminum compound of di-t-butyl salicylate (2.5) |
| Toner 5 | Hybrid resin 1 (40) Vinyl resin (60) | 5 | Ester wax (6) | Aluminum compound of di-t-butyl salicylate (2.5) |
| Toner 6 | Hybrid resin 1 (100) | 5 | Paraffin wax (6) | Aluminum compound of di-t-butyl salicylate (2.5) |
| Toner 7 | Hybrid resin 1 (100) | 5 | Paraffin wax (6) | Aluminum compound of di-t-butyl salicylate (2.5) |
| Toner 8 | Hybrid resin 1 (10) Vinyl resin (90) | 5 | Polyethylene wax (6) | — |
| Toner 9 | Polyester resin (100) | 11 | Polyethylene wax (6) | Boron compound of benzilic acid (8) |
| Toner 10 | Hybrid resin 2 (100) | 5 | Paraffin wax grafted with styrene (6) | Aluminum compound of di-t-butyl salicylate (2.5) |
| Toner 11 | Hybrid resin 3 (100) | 5 | Paraffin wax grafted with styrene (6) | Aluminum compound of di-t-butyl salicylate (2.5) |

TABLE 3

| | Acid value (mgKOH/g) | Hydroxyl value (mgKOH/g) | Acid value + Hydroxyl value (mgKOH/g) | Maximum peak temperature in DSC endothermic curve (° C.) | Molecular weight distribution by GPC using THF extraction of toner: Main peak in molecular weight range | Mw | Mn | Mw/Mn |
|---|---|---|---|---|---|---|---|---|
| Toner 1 | 30.7 | 27.4 | 58.1 | 78.2 | 20400 | 872000 | 4100 | 213 |
| Toner 2 | 30.1 | 27.5 | 57.6 | 71.6 | 20500 | 754000 | 4200 | 180 |
| Toner 3 | 30.1 | 21.5 | 51.6 | 79.2 | 10900 | 388000 | 3900 | 99 |
| Toner 4 | 34.5 | 32.9 | 67.4 | 79.1 | 19800 | 286000 | 3600 | 79 |
| Toner 5 | 23.1 | 19.5 | 42.6 | 72.6 | 9900 | 751000 | 3900 | 193 |
| Toner 6 | 30.8 | 28.0 | 58.8 | 79.6 | 17500 | 811000 | 3600 | 225 |
| Toner 7 | 30.8 | 28.0 | 58.8 | 79.6 | 17500 | 811000 | 3600 | 225 |
| Toner 8 | 20.1 | 5.5 | 25.6 | 122.5 | 7800 | 19800 | 3300 | 6 |
| Toner 9 | 39.1 | 39.4 | 78.5 | 122.3 | 16300 | 99700 | 3000 | 33 |
| Toner 10 | 15.0 | 6.2 | 21.2 | 78.1 | 7200 | 109000 | 3200 | 34 |
| Toner 11 | 41.6 | 39.0 | 80.6 | 78.2 | 18500 | 496000 | 3500 | 142 |

TABLE 4

| | Weight-average particle diameter (μm) | Average circularity | Maximum value of tan δ ($10^3$ to $10^4$ Hz) | tan δ ($5 \times 10^4$ Hz) | tan δ ($10^5$ Hz) | tan δ ($10^5$ Hz)/ tan δ ($5 \times 10^4$ Hz) |
|---|---|---|---|---|---|---|
| Toner 1 | 6.2 | 0.939 | 0.0051 | 0.0069 | 0.0085 | 1.23 |
| Toner 2 | 7.2 | 0.944 | 0.0049 | 0.0067 | 0.0090 | 1.34 |
| Toner 3 | 6.5 | 0.955 | 0.0055 | 0.0075 | 0.0102 | 1.36 |
| Toner 4 | 5.4 | 0.921 | 0.0046 | 0.0073 | 0.0079 | 1.08 |
| Toner 5 | 4.7 | 0.919 | 0.0054 | 0.0069 | 0.0095 | 1.38 |
| Toner 6 | 6.2 | 0.949 | 0.0058 | 0.0096 | 0.0145 | 1.51 |
| Toner 7 | 4.2 | 0.965 | 0.0057 | 0.0098 | 0.0142 | 1.45 |
| Toner 8 | 7.7 | 0.910 | 0.0063 | 0.0078 | 0.0073 | 0.94 |
| Toner 9 | 3.8 | 0.910 | 0.0125 | 0.0112 | 0.0176 | 1.57 |
| Toner 10 | 6.0 | 0.941 | 0.0065 | 0.0080 | 0.0110 | 1.37 |
| Toner 11 | 6.1 | 0.940 | 0.0058 | 0.0078 | 0.0111 | 1.42 |

Example 1

The toner 1 and the two-component developer 1 are evaluated as follows.

A 20,000-sheet running copying durability test was carried out using a commercially available full-color plain paper copying machine (CLC900; manufactured by Canon Inc.) and an original having the ratio of an image area to an entire paper area of 25% under the following conditions, respectively: (1) ordinary temperature and ordinary humidity (23° C./60%); (2) low temperature and low humidity (16° C./10%); and (3) high temperature and high humidity (30° C./80%).

Furthermore, stability against an environmental change was evaluated as follows. The copying machine in which the developer has been set was left for a whole day and night under low temperature and low humidity environments. Next, the machine was moved into high temperature and high humidity (30° C./80%) environments and was left for 1 hour. Then, 1,000-sheet copying test was carried out. Similarly, stability against an environmental change from high temperature and high humidity to low temperature and low humidity was evaluated.

Evaluation items in the above-mentioned tests are as follows.

(Triboelectric Charging Stability)

The developers before the durability test and after the durability test are respectively used as a sample and the amount of triboelectric charging was measured using an apparatus as shown in FIG. 1. The specific procedure of measuring the amount of triboelectric charging using the apparatus of FIG. 1 is as follows.

Approximately 0.5 g of the developer to be measured is put in a sample container 72 made of metal in which a screen 73 having a 500 mesh size is mounted on the bottom, and the container is closed with a metal cap 74. The whole mass $W_1$ (g) of the sample container 72 is measured. Next, the toner is removed through a suction port 77 by suction (preferably for 2 minutes) using an aspirator 71 (at least a part thereof in contact with the sample container 72 is made of an insulating material). At that time, the suction is performed while a flow rate controlling valve 76 is adjusted such that a pressure of a vacuum gage 75 is 250 mmAq.

Here, an electric potential of an electrometer 79 is expressed as V (volt). Furthermore, reference numeral 78 denotes a capacitor and a capacity thereof is expressed as C (μF). Finally, the whole mass $W_2$ (g) of the sample container 72 after the suction is measured.

The triboelectric charging amount of the toner (mC/kg) is calculated by the following equation:

$$\text{The triboelectric charging amount of the toner (or the external additives) (mC/kg)} = C \times V/(W_1 - W_2) \quad \text{[Equation 1]}$$

(Transferring Property)

Transferring property was determined as follows. Images before the durability test and after the durability test were respectively developed and transferred. The amount of the toner (per unit area) on a photoconductor before being transferred, and the amount of the toner (per unit area) on a transfer material after being transferred were respectively measured. The transferring property is determined by the following equation:

Transferring property (%)=The amount of the toner on a transfer material/The amount of the toner on a photoconductor before being transferred (Image Density)

An image density after the durability test was evaluated based on the change between the density at the beginning of the durability test and that after the durability test. A solid portion of the image on the original (initial image density: 1.50) was measured five times by a Macbeth densitometer (manufactured by Gretag Macbeth) to obtain the average thereof. Based on the mean value, the image density change was reviewed.

(Fogging)

Fogging was evaluated as follows. Whiteness degrees of white portions of the originals before being printed and after being printed are respectively measured by a reflectometer (manufactured by Tokyo Denshoku Co., Ltd.). A fogging density (%) was calculated using the difference therebetween and evaluated based on the following criteria.

A: excellent (less than 1.0%)

B: good (1.0% or more and less than 2.0%)

C: acceptable (2.0% or more and less than 3.0%)

D: bad (3.0% or more)

As a result of performing the above-mentioned evaluations of the two-component developer 1, excellent results were obtained. Specifically, the triboelectric charging amount was stable even after the 20,000-sheet running copying durability in any environmental conditions; the transferring property was outstanding; deterioration of the image density was small; and the fogging was suppressed. Further, regarding the stability against an environmental change, excellent results were obtained. Specifically, the triboelectric charging stability and the image density were stable even after the 1,000-sheet copying durability test. In addition, the transferring property and the fogging were outstanding. The results are shown in Tables 5 to 9.

TABLE 5

| | Results of 20,000-sheet running copying durability test under environmental of ordinary temperature and ordinary humidity conditions (23° C./60%) | | | | |
|---|---|---|---|---|---|
| | Triboelectric charging stability (mC/kg) | | | | |
| | Initial | After durability test | Change of transferring property (%) | Image density after durability test (Initial 1.50) | Evaluation of fogging |
| Example 1 | −25.7 | −25.9 | 94 → 94 | 1.49 | A |
| Example 2 | −26.2 | −26.9 | 95 → 93 | 1.47 | A |
| Example 3 | −23.5 | −26.4 | 95 → 91 | 1.47 | A |
| Example 4 | −20.1 | −19.2 | 92 → 91 | 1.51 | B |
| Example 5 | −25.6 | −26.2 | 90 → 87 | 1.45 | A |
| Comparative Example 1 | −22.4 | −24.8 | 94 → 90 | 1.35 | C |
| Comparative Example 2 | −23.6 | −22.5 | 93 → 85 | 1.29 | C |
| Comparative Example 3 | −18.7 | −15.1 | 88 → 80 | 1.58 | C |
| Comparative Example 4 | −20.3 | −19.9 | 85 → 77 | 1.20 | C |
| Comparative Example 5 | −22.6 | −24.1 | 94 → 90 | 1.44 | C |
| Comparative Example 6 | −27.6 | −25.1 | 92 → 91 | 1.53 | B |

TABLE 6

| | Results of 20,000-sheet running copying durability test under environmental of low temperature and low humidity conditions (16° C./10%) | | | | |
|---|---|---|---|---|---|
| | Triboelectric charging stability (mC/kg) | | | | |
| | Initial | After running test | Change of transferring property (%) | Image density after durability test (Initial 1.50) | Evaluation of fogging |
| Example 1 | −28.3 | −30.8 | 94 → 93 | 1.49 | A |
| Example 2 | −27.6 | −31.3 | 95 → 92 | 1.47 | A |
| Example 3 | −27.7 | −31.5 | 95 → 90 | 1.48 | A |
| Example 4 | −25.3 | −26.1 | 94 → 90 | 1.44 | A |
| Example 5 | −29.8 | −35.3 | 92 → 88 | 1.43 | A |
| Comparative Example 1 | −29.6 | −35.4 | 92 → 89 | 1.35 | C |
| Comparative Example 2 | −27.5 | −24.8 | 93 → 85 | 1.25 | C |
| Comparative Example 3 | −19.5 | −29.1 | 90 → 81 | 1.34 | B |
| Comparative Example 4 | −26.1 | −37.1 | 90 → 85 | 1.05 | C |
| Comparative Example 5 | −19.0 | −27.2 | 95 → 92 | 1.40 | C |
| Comparative Example 6 | −30.5 | −36.8 | 93 → 92 | 1.47 | B |

TABLE 7

| | Results of 20,000-sheet running test under environmental of high temperature and high humidity conditions (30° C./80%) | | | | |
|---|---|---|---|---|---|
| | Triboelectric charging stability (mC/kg) | | | | |
| | Initial | After running test | Change of transferring property (%) | Image density after durability test (Initial 1.50) | Evaluation of fogging |
| Example 1 | −21.5 | −20.3 | 93 → 92 | 1.52 | A |
| Example 2 | −22.4 | −20.6 | 94 → 91 | 1.52 | A |
| Example 3 | −22.7 | −19.5 | 95 → 91 | 1.55 | B |
| Example 4 | −16.8 | −17.2 | 93 → 91 | 1.47 | B |
| Example 5 | −20.8 | −21.0 | 92 → 90 | 1.54 | A |
| Comparative Example 1 | −24.5 | −16.7 | 91 → 87 | 1.64 | C |
| Comparative Example 2 | −22.0 | −16.5 | 92 → 82 | 1.61 | C |
| Comparative Example 3 | −12.5 | −13.7 | 85 → 80 | 1.38 | C |
| Comparative Example 4 | −20.9 | −15.3 | 86 → 79 | 1.69 | D |
| Comparative Example 5 | −13.4 | −14.6 | 89 → 89 | 1.52 | B |
| Comparative Example 6 | −25.5 | −19.2 | 92 → 87 | 1.60 | C |

TABLE 8

| | Results of 1,000-sheet running copying durability test under environmental change from high temperature and high humidity conditions to low temperature and low humidity conditions | | | | |
|---|---|---|---|---|---|
| | Triboelectric charging stability (mC/kg) | | | | |
| | Initial | After durability test | Change of transferring property (%) | Image density after durability test (Initial 1.50) | Evaluation of fogging |
| Example 1 | −22.7 | −26.8 | 92 → 90 | 1.47 | A |
| Example 2 | −24.5 | −27.5 | 91 → 90 | 1.47 | A |
| Example 3 | −22.8 | −29.3 | 91 → 91 | 1.45 | B |
| Example 4 | −17.7 | −22.5 | 93 → 90 | 1.50 | B |
| Example 5 | −22.8 | −28.6 | 91 → 89 | 1.47 | B |
| Comparative Example 1 | −22.5 | −27.6 | 94 → 85 | 1.38 | C |
| Comparative Example 2 | −22.0 | −24.1 | 94 → 82 | 1.32 | D |
| Comparative Example 3 | −14.5 | −23.6 | 85 → 80 | 1.34 | C |
| Comparative Example 4 | −20.3 | −31.9 | 85 → 79 | 1.20 | D |
| Comparative Example 5 | −27.8 | −34.9 | 94 → 90 | 1.40 | B |
| Comparative Example 6 | −13.5 | −25.1 | 92 → 90 | 1.35 | C |

TABLE 9

| | Results of 1,000-sheet running copying durability test under environmental change from low temperature and low humidity conditions to high temperature and high humidity conditions | | | | |
|---|---|---|---|---|---|
| | Triboelectric charging stability (mC/kg) | | | | |
| | Initial | After durability test | Change of transferring property (%) | Image density after durability test (Initial 1.50) | Evaluation of fogging |
| Example 1 | −27.7 | −24.1 | 94 → 94 | 1.52 | A |
| Example 2 | −27.7 | −24.2 | 95 → 93 | 1.53 | A |

TABLE 9-continued

| | Results of 1,000-sheet running copying durability test under environmental change from low temperature and low humidity conditions to high temperature and high humidity conditions | | | | |
|---|---|---|---|---|---|
| | Triboelectric charging stability (mC/kg) | | | | |
| | Initial | After durability test | Change of transferring property (%) | Image density after durability test (Initial 1.50) | Evaluation of fogging |
| Example 3 | −26.3 | −21.7 | 95 → 91 | 1.53 | B |
| Example 4 | −21.8 | −17.6 | 94 → 92 | 1.57 | B |
| Example 5 | −27.4 | −22.1 | 93 → 92 | 1.52 | A |
| Comparative Example 1 | −28.9 | −19.7 | 89 → 82 | 1.64 | D |
| Comparative Example 2 | −26.5 | −17.1 | 91 → 82 | 1.68 | D |
| Comparative Example 3 | −22.1 | −11.9 | 88 → 79 | 1.59 | C |
| Comparative Example 4 | −25.4 | −15.5 | 85 → 79 | 1.76 | D |
| Comparative Example 5 | −18.4 | −15.3 | 90 → 87 | 1.57 | B |
| Comparative Example 6 | −26.5 | −18.6 | 91 → 86 | 1.62 | B |

Examples 2 to 5

The toners 2 to 5 and the two-component developers 2 to 5 were evaluated in the same manner as Example 1.

As a result of the evaluation in Examples 2 to 5, excellent results were also obtained. Specifically, the triboelectrification was stable even after the 20,000-sheet running copying durability test in any environmental conditions; the transferring property was outstanding; deterioration of the image density was small; and the fogging was suppressed. Further, regarding the stability against an environmental change, excellent results were obtained. Specifically, the triboelectric charging stability and the image density were stable even after the 1,000-sheet running copying durability test. In addition, the transferring property and the fogging were outstanding. The results are shown in Tables 5 to 9.

Comparative Example 1

The toner 6 and the two-component developer 6 were evaluated in the same manner as Example 1.

As a result of the evaluation in Comparative Example 1, stability against an environmental change was deteriorated. Specifically, since the image density was largely varied after the 1,000-sheet running copying durability test, a stable image was not obtained. The results are shown in Tables 5 to 9.

Comparative Example 2

The toner 7 and the two-component developer 7 were evaluated in the same manner as Example 1.

As a result of the evaluation in Comparative Example 2, transferring property was deteriorated. Also, fogging was caused.

Furthermore, stability against an environmental change was deteriorated. Specifically, since image density was largely varied after the 1,000-sheet running copying durability test, a stable image was not obtained. The results are shown in Tables 5 to 9.

Comparative Example 3

The toner 8 and the two-component developer 8 were evaluated in the same manner as Example 1.

As a result of the evaluation in Comparative Example 3, deterioration of charge and transferring property under low temperature and low humidity conditions were especially remarkable. Further, fogging was somewhat deteriorated.

Furthermore, the image density was largely varied depending on an environmental change. Especially, deterioration of transferring property due to charge deterioration was remarkable depending on the change from low temperature and low humidity conditions to high temperature and high humidity conditions. The results are shown in Tables 5 to 9.

Comparative Example 4

The toner 9 and the two-component developer 9 were evaluated in the same manner as Example 1.

As a result of the evaluation in Comparative Example 4, since the particle diameter of the carbon black in the toner was large and dispersibility was insufficient, charge stability and transferring property were deteriorated in any environments. Furthermore, fogging under high temperature and high humidity conditions was remarkable.

Furthermore, since stability against an environmental change was extremely insufficient, charge was largely varied. As a result, since the image density was largely varied, a stable image was not obtained. Fogging was remarkably deteriorated. The results are shown in Tables 5 to 9.

Comparative Example 5

The toner 10 and the two-component developer 10 were evaluated in the same manner as in Example 1.

As a result of the evaluation in Comparative Example 5, charging property under low temperature and low humidity conditions was unstable and development property was slightly deteriorated. The results are shown in Tables 5 to 9.

Comparative Example 6

The toner 11 and the two-component developer 11 were evaluated in the same manner as in Example 1.

As a result of the evaluation in Comparative Example 6, transferring property was slightly deteriorated and development property was deteriorated. Specifically, development property from high temperature and high humidity to low temperature and low humidity conditions was deteriorated. The results are shown in Tables 5 to 9.

What is claimed is:

1. A black toner comprising toner particles containing at least a binder resin, carbon black and a releasing agent, wherein:

the toner particle has weight-average particle diameter of 3.5 to 8.0 μm;

total value of acid value and hydroxyl value of the toner is 30 to 75 mgKOH/g;

average circularity of particles contained in the toner having circle-equivalent diameter of 2 μm or more is 0.915 to 0.960;

loss tangent tan δ ($10^3$ to $10^4$ Hz) of the toner is represented by the following expression:

$$\tan\delta(10^3 \text{ to } 10^4 \text{ Hz}) \leqq 0.0060$$

where the loss tangent tan δ is represented by ∈"/∈' where ∈" denotes dielectric loss factor and ∈' denotes dielectric constant, and tan δ ($10^3$ to $10^4$ Hz) denotes the loss tangent in a frequency range of $10^3$ to $10^4$ Hz;

a ratio of tan δ ($10^5$ Hz) to tan δ ($5\times10^4$ Hz) is represented by the following expression:

$$1.05 \leqq \tan\delta(10^5 \text{ Hz})/\tan\delta(5\times10^4 \text{ Hz}) \leqq 1.40$$

where tan δ ($10^5$ Hz) denotes loss tangent at the frequency of $10^5$ Hz and tan δ ($5\times10^4$ Hz) denotes loss tangent at the frequency of $5\times10^4$ Hz; and wherein the toner has molecular weight distribution whose main peak is in a range of 3,000 to 40,000 in gel permeation chromatography (GPC) of tetrahydrofuran (THF) extraction, and has Mw/Mn of 70 or more where Mw denotes weight-average molecular weight and Mn denotes number-average molecular weight.

2. The black toner according to claim 1, wherein the toner has a peak temperature of maximum endothermic peak of 60 to 95° C. in a temperature range of 30 to 200° C. of an endothermic curve of differential scanning calorimetry (DSC) measurement.

* * * * *